US005924319A

United States Patent [19]

Ginzburg

[11] Patent Number: 5,924,319

[45] Date of Patent: Jul. 20, 1999

[54] ROLL CROSSING, OFFSETTING, BENDING AND SHIFTING SYSTEM FOR ROLLING MILLS

[75] Inventor: Vladimir B. Ginzburg, Pittsburgh, Pa.

[73] Assignees: Danieli United; International Rolling Mill Consultants, Inc., both of Pittsburgh, Pa.

[21] Appl. No.: 09/110,702

[22] Filed: Jul. 7, 1998

[51] Int. Cl.[6] ..... B21B 31/07

[52] U.S. Cl. ..... 72/247; 72/245

[58] Field of Search ..... 72/245, 247, 241.2, 72/241.6, 243.6, 242.2, 242.4, 240, 237

[56] References Cited

U.S. PATENT DOCUMENTS

| | | | |
|---|---|---|---|
| 4,453,393 | 6/1984 | Hiro et al. | 72/243 |
| 4,727,741 | 3/1988 | Ushifusa et al. | 72/245 |
| 4,843,854 | 7/1989 | Ackerly | 72/245 |
| 4,898,014 | 2/1990 | Ginzburg et al. | 72/247 |
| 5,655,398 | 8/1997 | Ginzburg | 72/247 |

FOREIGN PATENT DOCUMENTS

| | | |
|---|---|---|
| 0553480A3 | 12/1991 | European Pat. Off. . |
| 53-127353 | 7/1978 | Japan . |
| 61-259812 | 11/1986 | Japan . |
| 5277526 | 10/1993 | Japan . |
| 6226304 | 8/1994 | Japan . |
| 7060310 | 3/1995 | Japan . |

*Primary Examiner*—Joseph J. Hail, III
*Assistant Examiner*—Rodney Butler
*Attorney, Agent, or Firm*—Armstrong, Westerman, Hattori, McLeland & Naughton

[57] ABSTRACT

A combined work roll crossing, offsetting, bending and work roll axial shifting system for a rolling mill having a housing member on each side and at each end of each work roll, Mae West blocks mounted on the housing members, roll chocks surrounding the ends of the work rolls, a pusher member mounted on each of the Mae West blocks and movable into and out of contact with the corresponding roll chock, a first hydraulic piston/assembly mounted on each of the housing posts and connected to the corresponding pusher member to move the pusher member into contact with a corresponding chock and to effect crossing or offsetting of a corresponding work roll, a pair of roll bending second piston/cylinder assemblies mounted in each Mae West block such that the pistons contact the corresponding roll chocks to move the chocks toward or away from the corresponding work roll when the second cylinders are actuated, a third set of cylinder/piston assemblies mounted in the Mae West blocks for balancing the backup rolls, and a fourth set of piston/cylinder assemblies mounted on the housing, parallel to the work roll axis, and the pistons thereof being connected to the pusher members to shift the pusher members and associated chocks and work rolls in an axial direction of the work rolls.

14 Claims, 8 Drawing Sheets

ROLL CROSSING, OFFSETTING, BENDING AND SHIFTING SYSTEM FOR ROLLING MILLS

BACKGROUND

1. Field of the Invention

This invention relates to a rolling mill system having a capability of crossing, bending, offsetting and axially shifting the work rolls of the mill in order to reduce edge drop of a rolled metal workpiece (herein called strip), to increase strip crown control range, to reduce localized roll wear, and to improve strip surface quality.

2. Description of the Prior Art

Each of the roll-affecting functions above described is individually known to the prior art.

For example, shifting the work rolls in an axial direction for improved roll wear and enhanced strip properties, is shown in U.S. Pat. No. 4,898,014 which provides hydraulic cylinders disposed at the ends of the work rolls to shift those rolls axially, and a number of roll bending cylinders acting on the roll chocks to distribute the total roll bending force at the center of the roll chocks throughout the roll shifting range.

Roll crossing is exemplified by U.S. Pat. No. 4,453,393 which embodies paired roll crossing, i.e. the crossing of both work rolls and backup rolls in which housing-mounted jacks and associated brackets exert forces on a roll bearing case, and through it, on a roll chock to effect roll crossing. Japanese patent documents 52-77526; 52-77527; 53-127353; 62-26304, and European Patent Application No. 0 553 480 A3 show various other systems for roll crossing.

Combined roll crossing and shifting is described, for example, in U.S. Pat. No. 5,655,398 which provides, in addition to axial shifting cylinders at the ends of the respective work rolls, inclined surfaces on the roll chocks which, on shifting of the rolls, causes the rolls to cross. European Patent Application No. 0 506 138 A1 also shows roll crossing and shifting wherein hydraulic jacks exert forces on the roll chocks in the direction of rolling to cause work roll crossing, and wherein additional hydraulic cylinders are disposed at the ends of the respective work rolls and bear on the roll chocks in an axial direction to cause roll shifting. A similar construction for roll crossing and shifting also is shown in Japanese patent document 70-60310.

Japanese patent document 61-259812 discloses apparatus for roll shifting, offsetting and crossing wherein there is provided a first pair of inclined surfaced wedge members movable in a strip rolling direction, and a second pair of wedge members mounted on a common member with the roll chock and movable in the roll axial direction and slidable against the first wedge members, so that the work rolls may be shifted axially, offset and crossed.

SUMMARY OF THE INVENTION

This invention provides new and improved apparatus including pivoted pusher members mounted on Mae West blocks and bearing on the work roll chocks and, in respect to at least the chocks on one end of a work roll, and a first set of hydraulic piston/cylinders arrangements ("cylinders") mounted on the mill housing and movable in the direction of rolling and each having the a free end of the piston connected to one end of a pusher member so that, on actuation of the cylinders, the work rolls can be crossed or offset by forces exerted by the pusher members on the roll chocks. A second set of hydraulic roll bending cylinders is mounted in the Mae West blocks, and each cylinder being movable toward and away from the chocks so as to exert vertical forces on the respective upper and lower chocks in a direction to prevent twisting or turning of the roll chocks during crossing of the work rolls. The apparatus of the invention also includes a third set of hydraulic cylinders extending in the axial direction of the work rolls and which, on actuation, force the pusher members and associated roll chocks in the axial direction of the work rolls, causing shifting of those rolls. Combined roll shifting and crossing or offsetting is effected by cooperation of the first and third sets of cylinders in moving the pusher members in both the roll axis direction and in the rolling direction.

DESCRIPTION OF PREFERRED EMBODIMENTS

Figure 1:
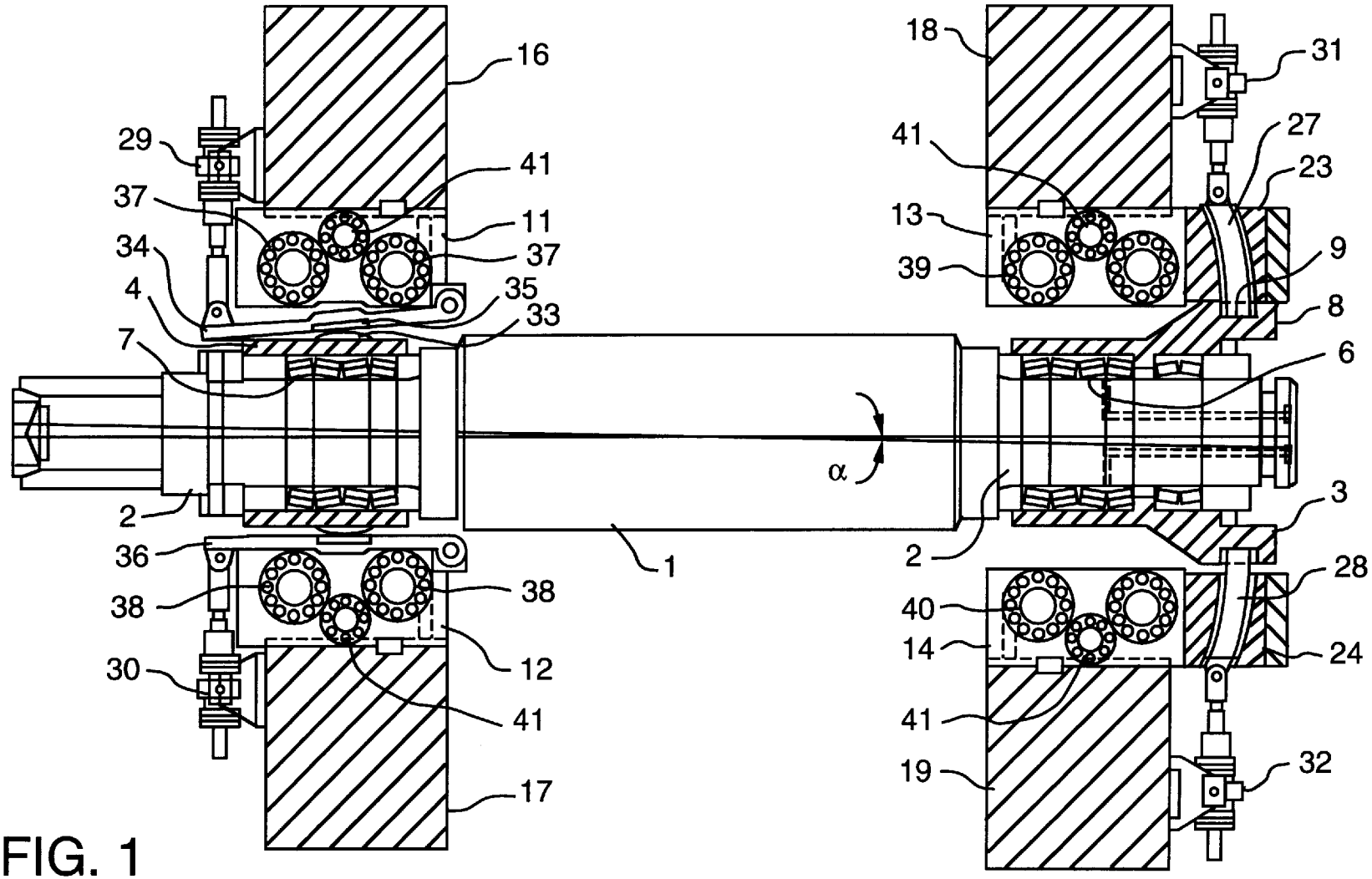
FIG. 1 is a top plan view of a portion of the apparatus of the invention, showing mechanisms for work roll crossing.

Turning, first, to FIG. 1 showing the combined roll crossing and offsetting means of the invention, a top work roll 1 has roll necks 2 rotatably mounted in roll chocks denoted generally by the numerals 3 and 4, with bearings 6 and 7 disposed between the necks 2 and the chocks 3 and 4. In a preferred embodiment, the chocks may have an offset end portion 8 of larger width than the rest of the chock, and having a slot 9 therein, as shown at the right hand end of the apparatus of FIG. 1. Similar chocks 3*a* and 4*a* (not shown in FIG. 1; see FIG. 5) are provided for the ends of the lower work rolls. Mae West blocks 11–14 are mounted in mill housing posts 16–19 opposite the ends of each of the work rolls, of which only the top roll is shown in FIG. 1. Also mounted on the Mae West blocks are pusher guides 21 and 22 (for a bottom work roll) and 23 and 24 (for a top work roll). Mounted in the pusher guides are pusher arms 25 and 26 (for the bottom work roll) and 27 and 28 (for a top work roll) each having one end thereof connected to the piston of a corresponding hydraulic cylinder 29–32 (see right hand side of FIG. 1, and FIG. 4). It is to be understood that FIG. 1 shows a top work roll only and that similar roll crossing and offsetting means, including cylinders 29*a*–32*a* corresponding to cylinders 29–32, are provided for the bottom roll also.

In the apparatus illustrated in FIG. 1, an alternative embodiment of the roll chock and crossing means is shown on the left side of the drawing. In this case, chock 4 comprises a cylindrical member mounted about the roll neck and having a first contact plate 33, e.g. of hardened steel, mounted thereon. Piston rods of cylinders 29 and 30 are pivotally connected to one end of each of a pair of pusher plates 34 and 36 each of which has the other end thereof pivotally connected to a corresponding Mae West block. Each of the pusher plates has a rounded and hardened second contact plate 35 mounted thereon and contactable with the lower contact plate 33 and which, together, provide a hardened, wear-resistant contact surface. Again, the bottom work roll crossing and offsetting means would be similarly constructed.

Figure 4:
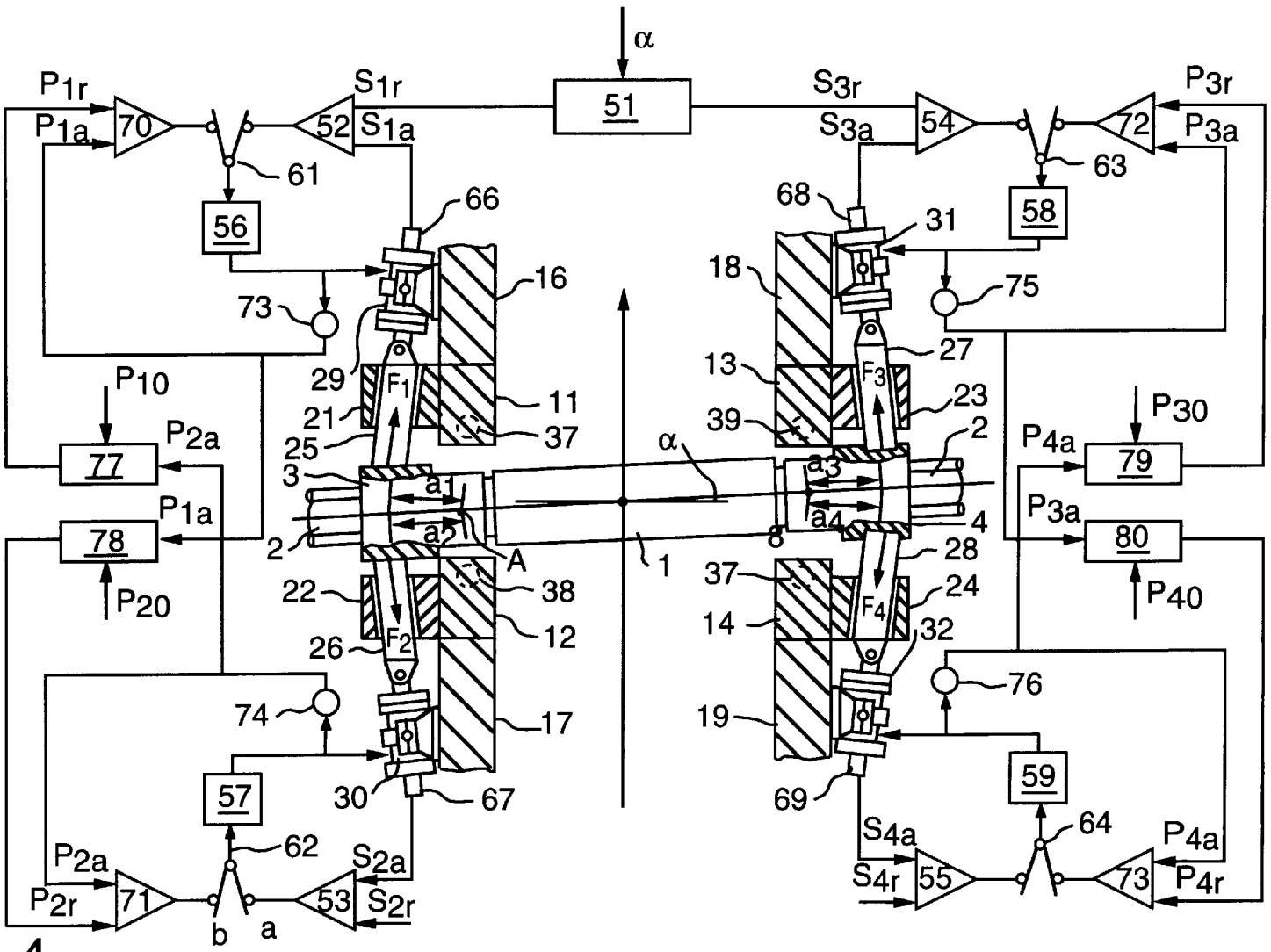
FIG. 4 comprises a top plan view of one embodiment of the roll crossing and offsetting means of the invention, together with a diagram of the control system therefor.

The pusher arm-type roll crossing mechanism, as shown on the right side of FIG. 1, can be used on either both ends of the work rolls, or on only one end as shown in FIG. 4. Actuation of cylinders 29–32 forces the pusher arms against the chocks 3 and 4 (or chocks 3*a* and 4*a* in case of the lower work roll) to move the chocks and associated work rolls in the rolling direction, to cross the work rolls, e.g. by an angle $\alpha$. In the case of the alternative embodiment shown on the left of FIG. 1, cylinders 29 and 30 transmit a roll crossing load, not through the axially-restraining pusher arms 27 and 28 as shown of the right side of FIG. 1, but through the pusher plates 34 and 36, thereby providing a sliding connection at the contact surface between the roll chock 4 and pusher plates 34 and 36, allowing the roll to move axially, without restraint in the axial direction, in response to a tendency of the roll to move left due to rotational action of the chock during crossing.

Figure 5:
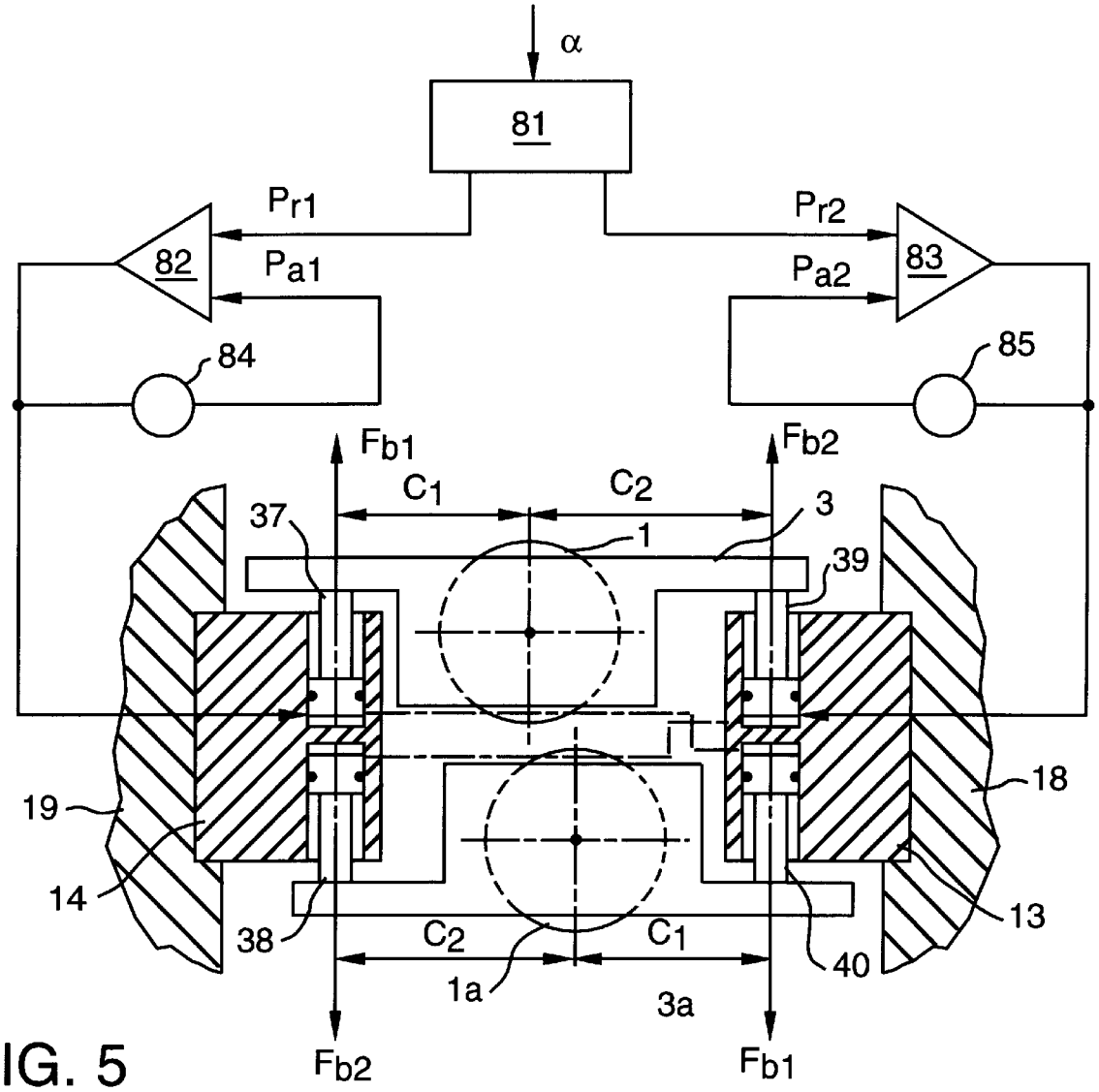
FIG. 5 comprises an end elevation, e.g. looking toward the right end of the work rolls as shown in FIG. 4 of a pair of crossed work rolls and the second set of hydraulic cylinders, for roll bending, together with a diagram of the control system for such means and its operation.

As shown in FIG. 1, and in more detail in FIG. 5 showing crossed top and bottom rolls, a second set of piston/cylinder assemblies comprising four pairs of roll bending cylinders, 37 and 39, for the one end of the top work roll 1 and 38 and 40 for same end of the bottom work roll la, are mounted within the Mae West blocks 13 and 14. Similarly, corresponding cylinders 37*a*–40*a* (not shown) are provided for the other end of each of the bottom work rolls. Such bending cylinders are effective in bending the work rolls for strip shape and/or profile control and in adjusting the roll gap between top and bottom work rolls.

Figure 4A:
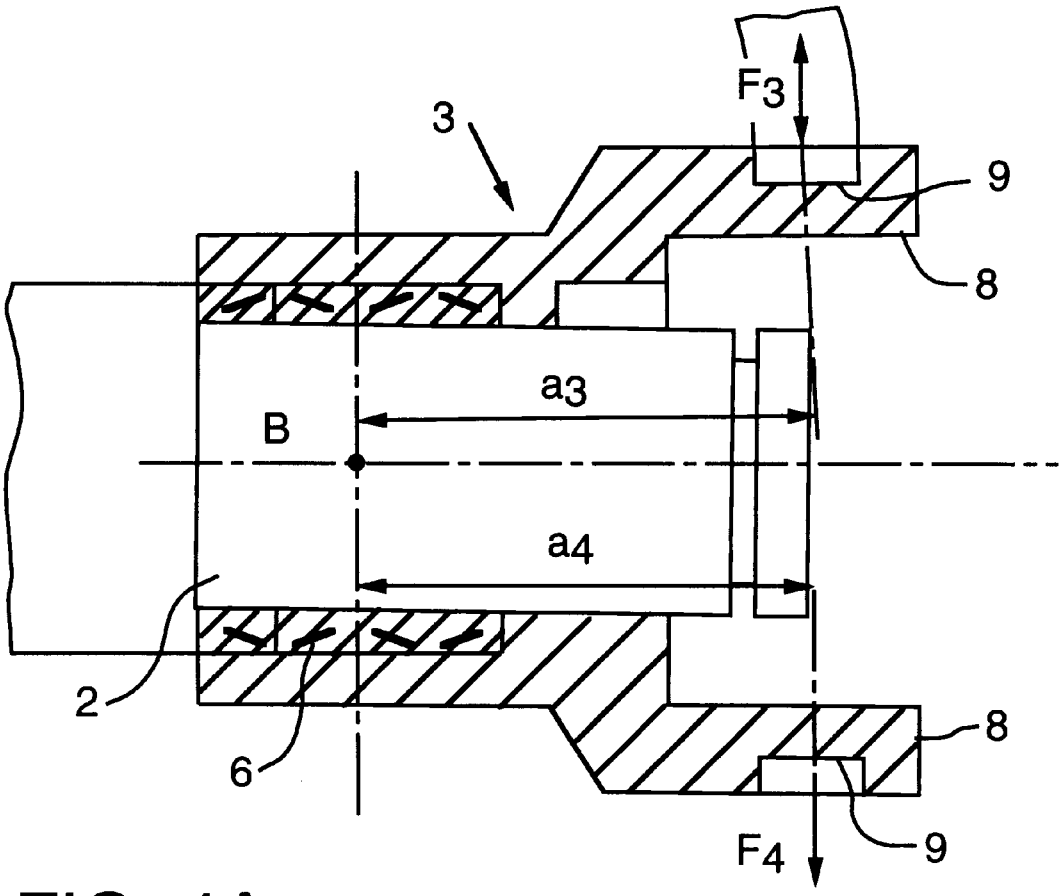
FIG. 4A is an enlarged and more detailed illustration of the end of a work roll, with roll chock and pusher members, and showing the forces generated due to roll crossing.

As shown in more detail in FIG. 4A, the force F is not applied to the center of the bearing 6 and, if the force components $F_3$ and $F_4$ are unequal, the chock 3 tends to turn or twist. Use of bending cylinders 37–40 and 37*a*–40*a* prevents such twisting or turning of the chocks during roll crossing.

Further, there are also mounted in the Mae West blocks, as shown in FIG. 1, a third set of balancing piston/cylinder assemblies 41 disposed adjacent the corresponding roll bending cylinders and, when a balancing cylinder is actuated (by an actuating means not shown), bearing on a roll chock of a corresponding backup roll 45 (partially indicated in dashed line in FIG. 5.) with a balancing force sufficient to lift the backup roll during roll changing and, during rolling, to lift the backup roll responsive to changes of strip thickness and to maintain a predetermined roll gap.

Figure 2:
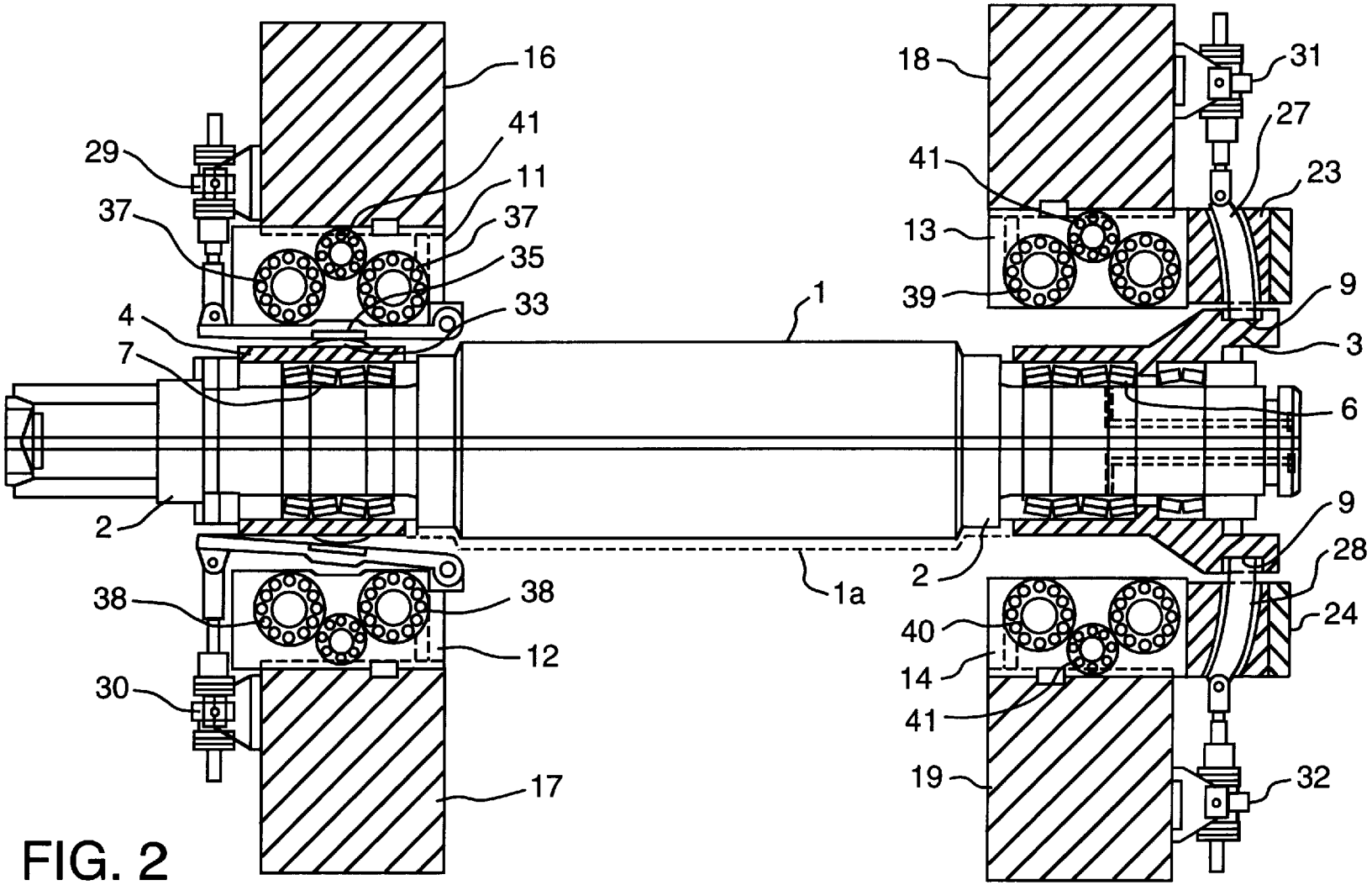
FIG. 2 is a view, similar to FIG. 1, showing work roll offsetting, using the same mechanism as for roll crossing.
Figure 2A:
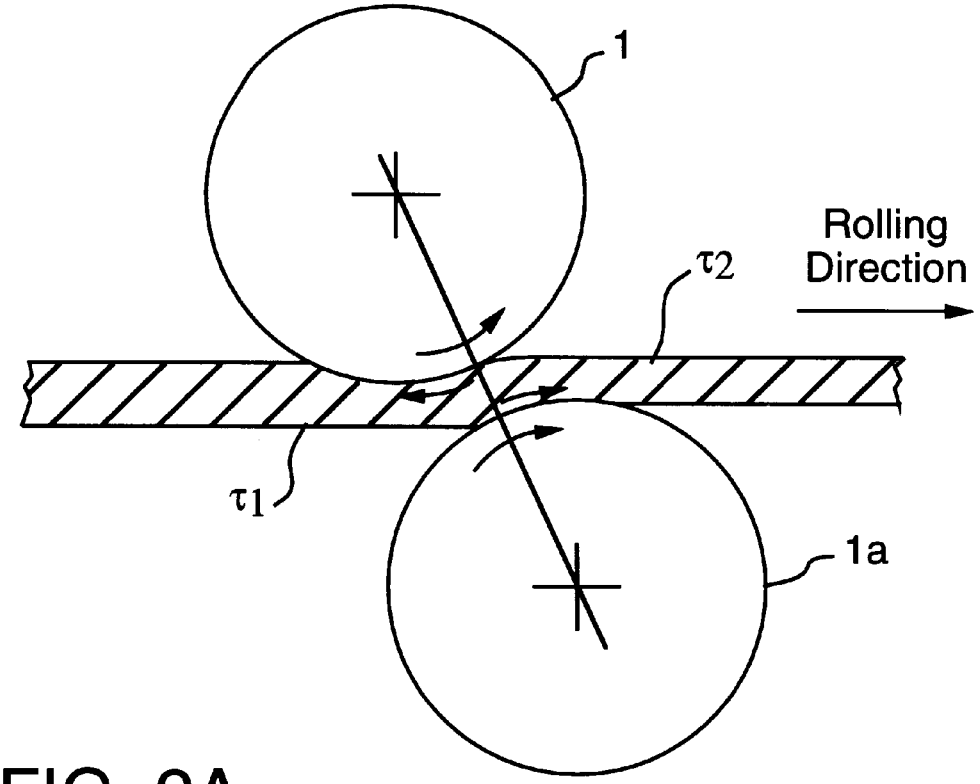
FIG. 2A is an end elevation of rolling a metal strip with work roll offsetting.
Figure 2B:
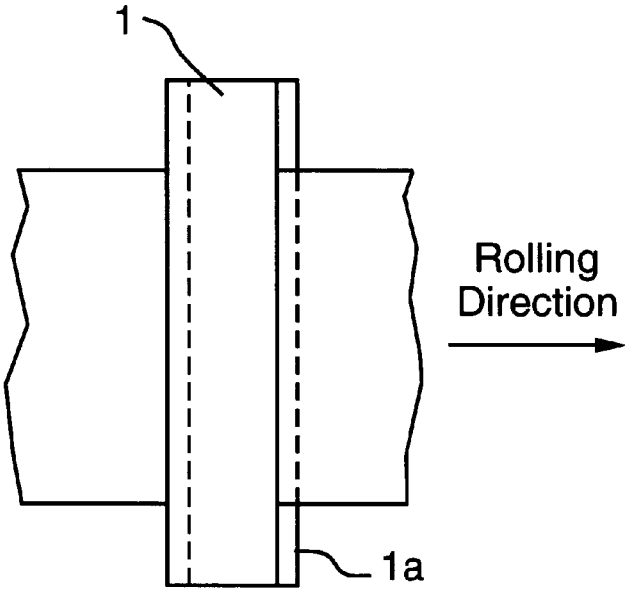
FIG. 2B is a sketch, in top plan view, of a pair of offset work rolls during rolling.

FIGS. 2A and 2B show, in exaggerated scale, the top roll 1 offset, in the rolling direction, from the bottom roll 1*a*. The same mechanism as described for roll crossing with respect to FIG. 1, is used for roll offsetting, wherein equal offsetting forces are applied, by cylinders 29–32, through the pusher members (pusher arms 25–28 or pusher plates, to the roll chocks on both ends of the work roll; thereby offsetting the work rolls from each other, one along the direction of rolling and the other against the rolling direction. Such roll offsetting introduces shear stresses $\tau_i$ and $\tau_2$ into the rolled strip to improve the strip surface.

Figure 3:
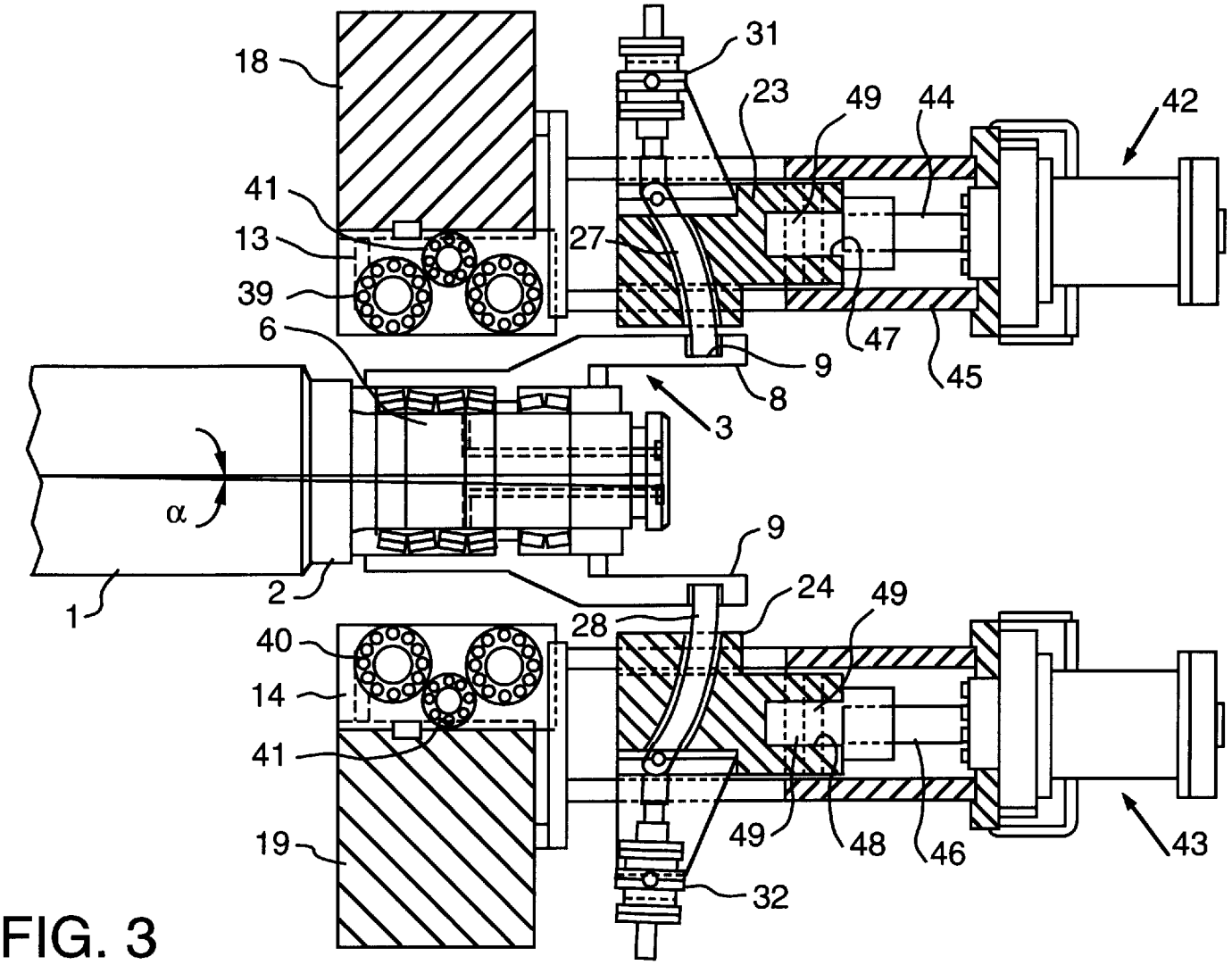
FIG. 3 is a similar view, of one end of the top work roll and associated roll crossing means, and further showing means for work roll shifting, with or without roll crossing.

In FIG. 3, showing the top work roll, there are illustrated additions to the apparatus of FIGS. 1 and 2 and providing means for axial shifting the work rolls and, by virtue of the unique roll crossing and offsetting mechanisms shown in FIGS. 1 and 2 and, as above described, combined shifting and crossing or offsetting. Thus, a fourth pair of hydraulic piston/cylinder assemblies, denoted generally by the numerals 42 and 43, is provided for each of the top and bottom work rolls and extending in the axial direction of the work rolls and spaced from the work roll centerline. Pistons 44 and 46, enclosed in a housing 45, have the free ends thereof connected to a corresponding pusher guide 23, 24 e.g. by securing the ends of the pistons in slots 47 and 48 in the pusher guides by means of pins 49. Thus, actuation of the cylinders 42, 43 forces the pusher guides 23 and 24, and associated pusher plates 27 and 28, to the left (FIG. 2) whereby the pusher plates, acting through the chock 3, forces the work roll to the left in an axial direction. At the same time, or in coordinated timing, with the same equipment, the rolls can be crossed or offset as well as axially shifted. It is to be understood that similar shifting means may be provided for both ends of the top and bottom work rolls.

It is a feature of the present invention to operate the hydraulic roll crossing and offsetting cylinders 29–32 and 29*a*–32*a* in particular configurations of position mode and pressure mode, e.g. by setting the cylinders on one side of a work roll in position mode and the opposed cylinders on the opposite side of the same work roll in pressure mode, so that the cylinders in pressure mode have a fixed, position-based force to oppose, thereby avoiding the opposed cylinders "fighting" each other as they would if all were in position mode. In the latter case, representing a fully mechanical system, the opposed cylinders must move exactly in synchronism. If not, the cylinders may fail. In the hydraulic system, with pressure mode control, this possibility is avoided and the cylinders can move either too fast or too slow with no such accompanying problem. When a work roll, first moved in, say, the rolling direction, is subsequently moved in the opposite direction, then the position/pressure modes of opposed cylinders are changed so that the original position mode becomes pressure mode and vice versa. Thus this position/pressure mode (master/slave relationship) provides greater operating flexibility than conventional modes of operation.

FIG. 4 is a control diagram for operating the rolling facility in accordance with the aforesaid techniques in roll crossing and offsetting, and showing the roll crossing and offsetting mechanism in for the top roll.

In this diagram, showing the top work roll crossing and offsetting, e.g. for roll crossing by an angle $\alpha$, that angle is fed into a position reference generator 51 which produces position reference signals $S_{1r}$–$S_{4r}$ for input into, respectively, position regulators 52–55 which act, by means of servovalves 56–59, through operational mode switches 61–64, having positions "a" and "b" as shown in FIG. 4, to control the positions of cylinders 29–32 as reflected by position transducers 66–69. Pressure regulators 70–73 act, through the valves 56–59, to control the pressure in cylinders 29–32 as reflected by pressure transducers 73–76.

During roll crossing by the angle $\alpha$, switches 61 and 64 are placed in position "a," placing cylinders 29 and 32 in position mode, while switches 62 and 63 are in position "b," placing cylinders 30 and 31 in pressure mode, whereby each cylinder in position mode is opposed by a cylinder in pressure mode in accordance with the present invention. Pressure reference signals are generated by pressure reference generators 77–80; for example, signals $P_{2r}$ and $P_{3r}$ are generated by pressure reference generators 78 and 79, based on predefined values $P_{20}$ and $P_{30}$ respectively (not exceeding about 80% of the maximum cylinder pressure) and on pressure signals $P_{2a}$ and $P_{3a}$ representing actual pressure within the opposed cylinders 29 and 32. As shown in FIG. 4, signals $P_{2r}$ and $P_{3r}$ are input into pressure regulators 71 and 72 respectively. Similarly, signals $P_{1r}$ and $P_{4r}$ are generated by pressure reference generators 77 and 80, based on similar predefined reference and actual cylinder pressures for input into pressure regulators 70 and 73 respectively.

During rolling, the operating modes of the cylinders 29–32 are reversed so that cylinders 30 and 31 are in position mode and controlled, through servovalves 57 and 58, by position regulators 53 and 54, to withstand the forces F2 and F3 (as shown in FIG. 4) generated due to roll crossing. At the same time, cylinders 29 and 32 are in pressure mode and controlled by pressure regulators 70 and 73, through servovalves 56 and 59, in accordance with pressure reference signals $P_{1r}$ and $P_{4r}$ from pressure reference generators 77 and 80 based predefined pressure references $P_{10}$ and $P_{40}$, and on actual pressures $P_{2a}$ and $P_{3a}$ inside cylinders 30 and 31.

It will be understood that the operating means and controls for the bottom work roll are similar to those for the top work roll as shown in FIG. 4.

As will be seen from FIGS. 4 and 4A, the opposed forces F1 and F2 and F3 and F4 generated during roll crossing are not applied to the centers of the work roll bearings, shown in FIG. 4 as points A and B at opposite ends of the work rolls. To avoid twisting of the chock due to unequal applied forces, the balance of forces in respect to the centers of the work roll bearings A and B must be maintained. This objective is facilitated by application of the following relationships:

$$F_1 \times a_1 = F_2 \times a_2 \text{ in respect to point A} \qquad \text{Equation 1}$$

$$F_3 \times a_3 = F_4 \times a_4 \text{ in respect to point B} \qquad \text{Equation 2}$$

Where:

- $a_1$ is the distance from the point of application of force F1 against cylinder 29 to point A;
- $a_2$ is the distance from the point of application of force F2 against cylinder 30 to point A;
- $a_3$ is the distance from the point of application of force F3 against cylinder 31 to point B, and
- $a_4$ is the distance from the point of application of force F4 against cylinder 32 to point B, and where, in each case, the distances $a_1$–$a_4$ are affected by the cross-rolling angle $\alpha$.

As above described, one of the functions of the roll bending cylinders, as illustrated in FIG. 5, is to aid in controlling roll bending and in avoiding twisting of the chocks during roll crossing. In that FIG., the roll crossing angle $\alpha$ is input into a pressure reference generator 81 which produces pressure reference signals $P_{r1}$ and $P_{r2}$ based on the angle a and total roll bending force $F_b$. These pressure reference signals are input, respectively, into pressure regulators 82 and 83, along with actual pressure signals $P_{a1}$ and $P_{a2}$ generated by pressure transducers 84 and 85 from the pressures in cylinders 37 and 39.

The following balance of moments of forces is provided in respect to the centers of the top and bottom work rolls 1 and 1*a:*

$$F_{b1} \times C_1 = F_{b2} C_2 \qquad \text{Equation 3}$$

where

- $C_1$ is the distance from the center line of the top roll 1 to the centerline of hydraulic roll bending cylinder 37 and from the centerline of the bottom roll 1*a* to the centerline of cylinder 40; and
- $C_2$ is the distance from the center line of the top roll 1 to the centerline of hydraulic roll bending cylinder 39 and from the centerline of the bottom roll 1*a* to the centerline of cylinder 38.

The values of the forces $F_{b1}$ and $F_{b2}$ are determined to maintain the balance of moments of Equation 3 by the control means above described in respect to FIG. 5.

Similar provisions are made for the lower work roll and for the other ends of the respective work rolls.

Figure 6:
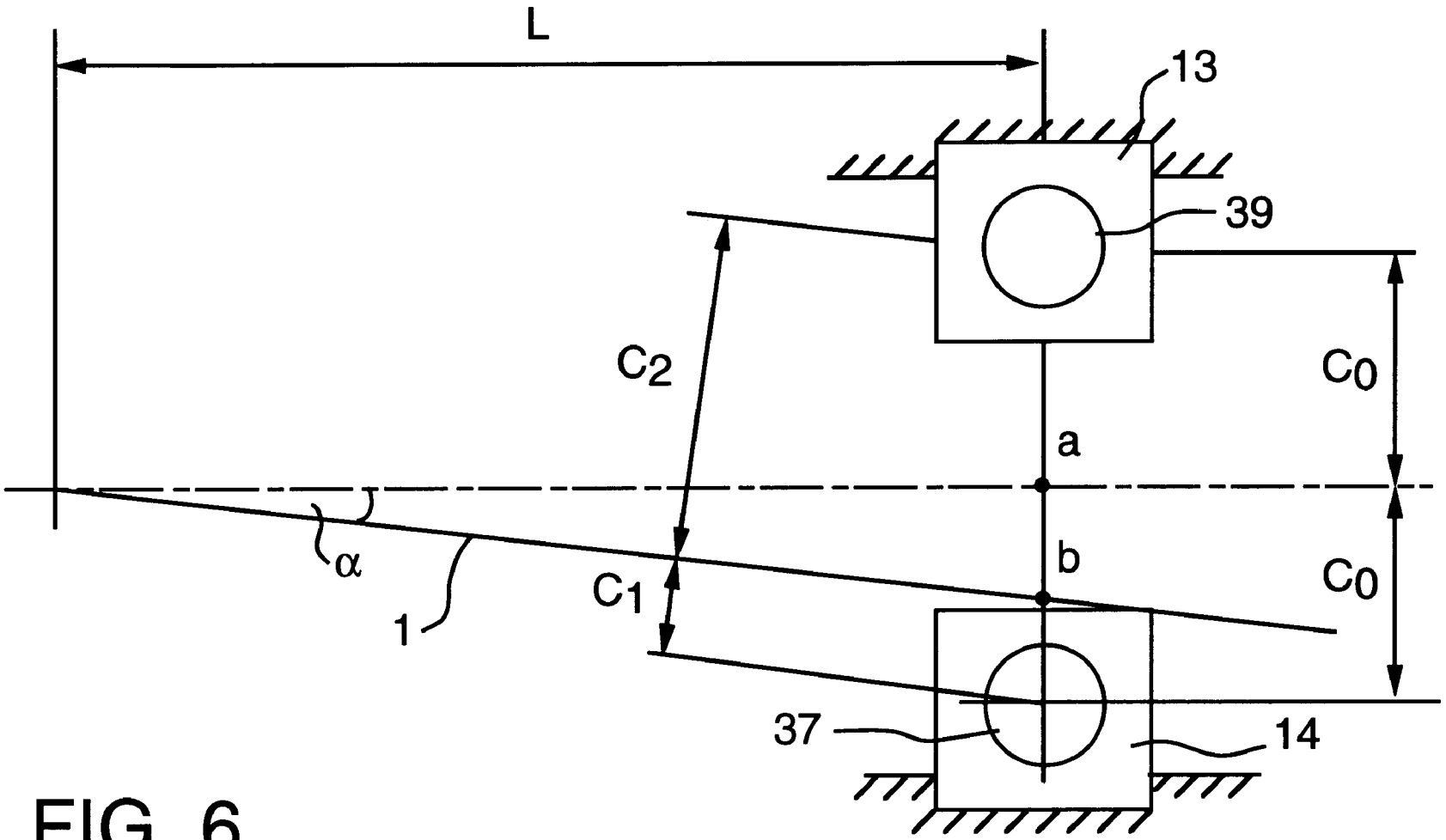
FIG. 6 is a sketch showing parameters relevant to the determination of the roll bending forces exerted by the roll bending cylinders shown in FIG. 5.

In FIG. 6, constituting a sketch representing a top plan view of the apparatus of FIG. 5, there is shown the dimensional parameters applicable to the roll bending cylinders, e.g. top roll cylinders 37 and 39, disposed on opposite sides of the top work roll 1 at the roll end shown in FIG. 5, when the work rolls are crossed at an angle $\alpha$. Parameters $C_1$ and $C_2$ are as above described in connection with Equation 3, $C_0$ is the fixed distance between the centerline of the respective cylinders 37 and 39, spaced a distance L from an end of work roll 1, and the centerline of the uncrossed roll 1, and a and b are points where a line through the centers of the cylinders 37 and 39 intersect the centerlines of respective uncrossed and crossed work roll 1 where $\alpha$ is the roll crossing angle.

Thus, by means of the invention as above described, the work rolls of a rolling mill can be crossed, offset in the rolling direction and shifted in the axial direction of the rolls to provide the known benefits of such work roll manipulations with a single, integrated apparatus of improved operating capability.

What is claimed is:

1. A system for combined roll crossing and offsetting of work rolls in a rolling mill, comprising:

a. a top work roll and a bottom work roll each having a neck portion at the end of each roll;

b. a mill housing post disposed at each end and on each side of each the work rolls;

c. a Mae West block mounted in each housing post adjacent and spaced from each of the work rolls;

d. a roll chock fixedly mounted about each end of each work roll;

e. a bearing disposed between each chock and the corresponding roll neck;

f. a first set of hydraulic piston/cylinder assemblies wherein a cylinder is mounted on each housing post with a free end of the piston directed toward a corresponding chock, and g. a pusher member connected to a corresponding cylinder mounted on each Mae West block, movable toward and away from a corresponding chock and contactable with such chock, and wherein the pusher members corresponding to at least one end of each work roll are arranged, on actuation of a corresponding cylinder, to move the chock in the rolling direction, whereby the work rolls are crossed or offset from one another in response to the magnitude and direction of forces exerted on a roll by a corresponding cylinder through the corresponding pusher members.

2. A system according to claim 1, wherein each of the pusher members disposed adjacent one end of the work roll comprises an apertured pusher guide mounted on each Mae West block between a corresponding cylinder and chock, and an elongated pusher arm slidably movable in the guide aperture and connected at one end to the corresponding cylinder and at the other end to the corresponding chock.

3. A system according to claim 2, wherein the diameter of the chock disposed at least at one end of each work roll is enlarged as compared to a remaining portion of the chock and the end of the chock is provided with a first slot facing the corresponding pusher arm.

4. A system according to claim 3, wherein one end of the pusher arm is disposed in the corresponding first slot, whereby, on actuation of the pusher arm, a roll crossing or offsetting force is applied to the chock and axial movement of the work roll is substantially prevented.

5. A system according to claim 1, wherein the chock disposed at one end of each work roll is in the form of a cylinder of uniform diameter along the length thereof and having a first hardened contact plate mounted on an outer surface of the chock, and wherein the pusher member comprises a pusher plate pivotable at one end of the pusher plate to a corresponding Mae West block and, at the other end, to the piston of a corresponding first piston/cylinder assembly and having a second contact plate disposed thereon and which, on actuation of a corresponding first cylinder, contacts the first contact plate, whereby through contacting first and second contact plates roll crossing or offsetting forces are applied from the cylinder to the chock, and axial movement of a corresponding work roll is permitted.

6. A system according to claim 1, wherein the chock disposed at one end of each work roll is in the form of a cylinder of uniform diameter along the length thereof and having a first hardened contact plate mounted on an outer surface of the chock, and wherein the pusher member comprises a pusher plate pivotable at one end of the pusher plate to a corresponding Mae West block and, at the other end, to the piston of a corresponding first piston/cylinder assembly and having a second contact plate disposed thereon and which, on actuation of a corresponding first cylinder, contacts the first contact plate, whereby through contacting first and second contact plates roll crossing or offsetting forces are applied from the first cylinder to the chock, and axial movement of a corresponding work roll is permitted.

7. A system according to claim 1, further comprising a second set of top and bottom hydraulic bending piston/cylinder assemblies disposed in each Mae West block and wherein the pistons of the respective assemblies are contactable with corresponding work roll chocks whereby, on actuation of the pistons, to contact those chocks to move the chocks in a vertical direction to bend the work rolls for strip shape and/or profile control, for adjusting the roll gap between the top and bottom work rolls, and for limiting a tendency of the roll chocks to twist during crossing.

8. A combined work roll crossing, offsetting, bending and work roll axial shifting system for a rolling mill having a housing member on each side and at each end of each work roll, Mae West blocks mounted on the housing members, roll chocks surrounding the ends of the work rolls, a pusher member mounted on each of the Mae West blocks and movable into and out of contact with the corresponding roll chock, a first hydraulic piston/assembly mounted on each of the housing posts and connected to a corresponding pusher member to move the pusher member into contact with a corresponding chock and thereby to effect crossing or offsetting of a work roll when the corresponding cylinder is actuated, and a second set of roll bending piston/cylinder assemblies comprising a pair of such assemblies mounted in each Mae West block such that the pistons thereof contact the corresponding roll chocks to bend the corresponding work rolls in an upward or downward direction when the corresponding second cylinders are actuated.

9. A system according to any one of claims 1 to 8, further comprising a third set of balancing piston/cylinder assemblies mounted respectively in a corresponding Mae West block, wherein the pistons thereof are contactable with a corresponding backup roll chock and, on actuation of the cylinders during rolling, with a force sufficient to lift the backup rolls in conformity with vertical movement of the corresponding work rolls responsive to changes of strip thickness and to maintain a predetermined roll gap and, on roll changing, to lift the backup rolls, thereby permitting changing of the work rolls.

10. A system according to claim 9, further comprising fourth hydraulic piston/cylinder assembly sets mounted in the mill housing on each side of each end of each work roll and disposed in parallel to the work roll axis and having a free end of each piston connected to a corresponding pusher guide and adapted, on actuation of a corresponding cylinder, to shift a corresponding work roll chock and associated work roll a desired distance in an axial direction of the work roll.

11. A system according to one of claims 1 to 8, further comprising a position reference generator for generating position reference signals based on a work crossing angle and, for each end of each work roll, a position transducer for determining the position of the piston of a first cylinder/piston assembly, a position regulator for each first cylinder to receive position reference signals from the controller and from the pressure transducer, a servovalve to control the position or pressure of the first cylinder, a first pressure transducer to determine actual pressure in the first cylinder and to generate a corresponding first cylinder pressure signal, a first pressure reference generator to receive an actual pressure signal from the first pressure transducer and a pre-set pressure signal and to generate a first pressure reference signal for input to a first pressure reference generator on the opposite side of the work roll, a first pressure regulator to receive pressure signals from the pressure transducer and the first pressure reference generator and to output a pressure signal to the servovalve, and a switch disposed between the position regulator and the first pressure regulator to effect either position mode or pressure mode of the first piston/cylinder assemblies.

12. A system according to any one of claims 7 and 8, further comprising a position reference generator for generating position reference signals based on a work crossing angle and, for each end of each work roll, a position transducer for determining the position of the piston of a first cylinder/piston assembly, a position regulator for each first cylinder to receive position reference signals from the controller and from the pressure transducer, a servovalve to control the position or pressure of the first cylinder, a first pressure transducer to determine actual pressure in the first cylinder and to generate a corresponding first cylinder pressure signal, a first pressure reference generator to receive an actual pressure signal from the first pressure transducer and a pre-set pressure signal and to generate a first pressure reference signal for input to a first pressure reference generator on the opposite side of the work roll, a first pressure regulator to receive pressure signals from the pressure transducer and the first pressure reference generator and to output a pressure signal to the servovalve, and a switch disposed between the position regulator and the first pressure regulator to effect either position mode or pressure mode of the first piston/cylinder assemblies, a second pressure reference generator for receiving a cross rolling angle signal and a signal representing a required roll-bending force and for generating a second pressure reference signal, and, for each side of the corresponding work roll, a pair of second pressure transducers for determining the pressures in corresponding top and bottom second bending cylinders and for generating corresponding actual pressure signals, a pair of second pressure regulators for receiving the second pressure signal from the second pressure reference generator and an actual pressure signal from the second pressure transducer and, with the corresponding second pressure transducer, for generating a pressure control signal for input to the corresponding second cylinder to adjust the second cylinder pressure and, thereby, the bending force applied to the corresponding chock and work roll.

13. A method of operating the system of one of claims 1-8, comprising providing means to change each of the first piston/cylinder assemblies from a position mode of operation to a pressure mode of operation, said means including a switch for setting each said assembly in the position or pressure mode, and setting said switches corresponding to each end of the top and bottom work rolls so that one first cylinder on one side of a work roll is operated in position mode and the first cylinder on the opposite side of the work roll is operated in pressure mode whereby the first cylinder in pressure mode has a fixed, position-based force to oppose.

14. A method of operating the system of claim 10, comprising mounting the fourth piston/assembly parallel to the corresponding work roll axis, connecting the free end of the piston to a corresponding pusher member, actuating the cylinder and shifting the pusher member and associated roll chock and work roll in the work roll axial direction.

* * * * *